US011819172B2

(12) United States Patent
Niu

(10) Patent No.: US 11,819,172 B2
(45) Date of Patent: Nov. 21, 2023

(54) SCRUBBING ROBOT

(71) Applicant: SHANXI JIASHIDA ROBOT TECHNOLOGY CO., LTD, Shanxi (CN)

(72) Inventor: Liqun Niu, Shanxi (CN)

(73) Assignee: SHANXI JIASHIDA ROBOT TECHNOLOGY CO., LTD., Taiyuan (CN)

( * ) Notice: Subject to any disclaimer, the term of this patent is extended or adjusted under 35 U.S.C. 154(b) by 541 days.

(21) Appl. No.: 17/267,486

(22) PCT Filed: Feb. 18, 2019

(86) PCT No.: PCT/CN2019/075339
§ 371 (c)(1),
(2) Date: Feb. 9, 2021

(87) PCT Pub. No.: WO2019/184616
PCT Pub. Date: Oct. 3, 2019

(65) Prior Publication Data

US 2021/0290010 A1 Sep. 23, 2021

(30) Foreign Application Priority Data

Mar. 28, 2018 (CN) ..... 201810265392.2
Mar. 28, 2018 (CN) ..... 201810267375.2

(51) Int. Cl.
*A47L 1/02* (2006.01)
*A47L 11/282* (2006.01)
*A47L 11/40* (2006.01)

(52) U.S. Cl.
CPC ..... *A47L 1/02* (2013.01); *A47L 11/282* (2013.01); *A47L 11/4011* (2013.01);
(Continued)

(58) Field of Classification Search
CPC ..... A47L 1/02; A47L 11/28; A47L 11/282; A47L 11/40; A47L 11/4013;
(Continued)

(56) References Cited

U.S. PATENT DOCUMENTS

2017/0164797 A1 6/2017 Abramson et al.

FOREIGN PATENT DOCUMENTS

CN 105212822 A * 1/2016 ..... A47L 1/02
CN 105686766 A 6/2016
(Continued)

OTHER PUBLICATIONS

English translation of CN106805852A (Year: 2017).*
(Continued)

*Primary Examiner* — Brian D Keller
*Assistant Examiner* — Sukwoo James Chang

(57) ABSTRACT

The present invention provides a scrubbing robot, including a window scrubbing device, including a suction assembly configured to be sucked to a window body, a first travelling assembly configured to move on the window body, and a window body cleaning system; and a floor scrubbing device, including a second travelling assembly configured to move on a floor and a floor cleaning system, where the body of the floor scrubbing device has a mounting recess, and the window scrubbing device is configured to be capable of being embedded into and removed from the mounting recess. The scrubbing robot is an integrally functional cleaning robot integrating multiple functions of floor sweeping, floor scrubbing, and window scrubbing.

17 Claims, 13 Drawing Sheets

(52) U.S. Cl.
CPC ..... *A47L 11/4013* (2013.01); *A47L 11/4038* (2013.01); *A47L 11/4041* (2013.01); *A47L 11/4066* (2013.01); *A47L 11/4072* (2013.01); *A47L 2201/04* (2013.01)

(58) Field of Classification Search
CPC ..... A47L 11/4038; A47L 11/4063; A47L 11/4066; A47L 11/408; A47L 11/4083; A47L 11/4088; A47L 2201/00
See application file for complete search history.

(56) References Cited

FOREIGN PATENT DOCUMENTS

| | | | | | |
|---|---|---|---|---|---|
| CN | 205338822 | U | | 6/2016 | |
| CN | 106805852 | A | * | 6/2017 | ..... A47L 11/24 |
| CN | 106805852 | A | | 6/2017 | |
| CN | 106993987 | A | | 8/2017 | |
| CN | 107137022 | A | * | 9/2017 | ..... A47L 11/28 |
| CN | 206586899 | U | | 10/2017 | |
| CN | 108451433 | A | | 8/2018 | |
| CN | 108451434 | A | | 8/2018 | |
| CN | 108514370 | A | | 9/2018 | |

OTHER PUBLICATIONS

English translation of CN107137022A (Year: 2017).*
English translation of CN105212822A (Year: 2016).*
International Search Report of PCT/CN2019/075339.
Written Opinion of PCT/CN2019/075339.

* cited by examiner

SCRUBBING ROBOT

CROSS-REFERENCE TO RELATED APPLICATIONS

This Application is a national stage application of PCT/CN2019/075339. This application claims priorities from PCT Application No. PCT/CN2019/075339, filed Feb. 18, 2019, and from the Chinese patent applications 201810267375.2 and 201810265392.2 both filed Mar. 28, 2018, the content of which is incorporated herein in the entirety by reference.

TECHNICAL FIELD

The present invention relates to the field of cleaning instrument, and in particular, relates to scrubbing robots.

BACKGROUND

As the improvement of people's living standard, people pay more attention to home living environments, in particular, think a great deal of indoor cleaning; in this context, more and more indoor cleaning tools appear, to replace or release heavy manual housework. For daily floor dust and debris cleaning, a large amount of labor is paid; currently, floor mopping robots are gradually used for completing the floor cleaning. For daily window body dust cleaning, window scrubbing robots are gradually used for completion.

The existing art has the following defects: the floor scrubbing robot and the window scrubbing robot are respectively designed for the floor and the window body, the body travelling modes and rubbish types in two application scenes are different and the specific structures thereof are also different, so that they cannot be exchanged for usage. Therefore, a user needs to separately purchase the floor scrubbing robot and the window scrubbing robot, rendering high costs, more occupied storage spaces, and bad user experience.

SUMMARY OF THE INVENTION

To overcome disadvantages of the prior art, the present invention provides a scrubbing robot.

Specifically, the technical solution thereof is as follows:

a scrubbing robot, including: a window scrubbing device, including a window body cleaning system, a suction assembly configured to be sucked to a window body, and a first travelling assembly configured to move on the window body; and a floor scrubbing device, including a floor cleaning system and a second travelling assembly configured to move on a floor, where the body of the floor scrubbing device has a mounting recess, and the window scrubbing device is configured to be capable of being embedded into and removed from the mounting recess.

In the present invention, the scrubbing robot is an integrally functional cleaning robot integrating multiple functions of floor sweeping, floor scrubbing, and window scrubbing. The window scrubbing device can conveniently be embedded into or removed from the floor scrubbing device. After the window scrubbing device is embedded into the floor scrubbing device, a complete floor scrubbing robot is formed; after the window scrubbing device is removed from the floor scrubbing device, an independent window scrubbing machine is formed. It has rich functions and low costs, occupies a smaller storage space, is convenient to operate, and improves user experience.

To enable the purpose, features, and advantages above of the present invention to be understood more obviously and easily, preferable embodiments are used hereinafter in combination with the accompanying drawings for making explanations as follows.

DETAILED DESCRIPTION

Embodiment

This embodiment provides a scrubbing robot, configured to perform floor and window body cleaning operations instead of manual work.

Figure 1:
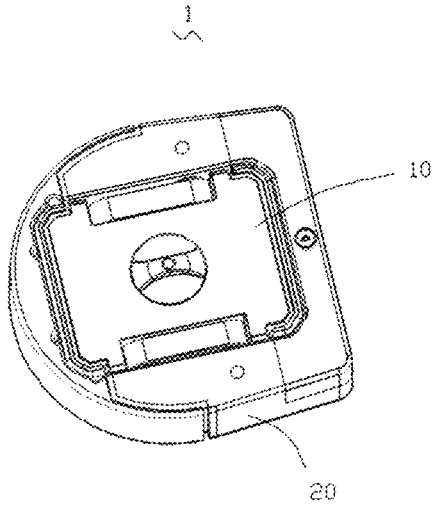
FIG. 1 is an oblique view of a scrubbing robot in embodiments.
Figure 2:
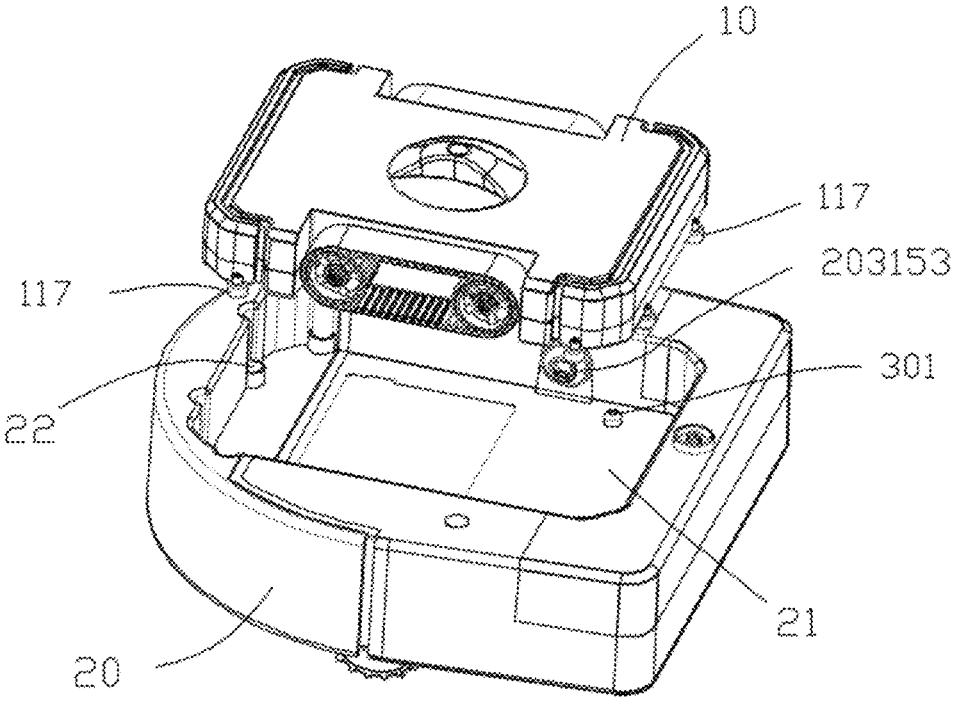
FIG. 2 is an explosive view of a scrubbing robot in embodiments.

As shown in FIGS. 1 and 2, the scrubbing robot 1 includes a window scrubbing device 10 and a floor scrubbing device 20. The window scrubbing device 10 includes a window body cleaning system, a suction assembly configured to be sucked to a window body, and a first travelling assembly configured to move on the window body; and a floor scrubbing device includes a floor cleaning system and a second travelling assembly configured to move on a floor; a body 201 of the floor scrubbing device has a mounting recess 21, and the window scrubbing device 10 is configured to be capable of being embedded into and removed from the mounting recess 21.

Preferably, the window scrubbing device 10 further includes a power output assembly; the floor scrubbing device 20 further includes a power input assembly; the power output assembly is connected to and drives the power input assembly; and the power input assembly is connected to and drives the second travelling assembly, so that the second travelling assembly is driven by the window scrubbing device to drive the floor scrubbing device to move on the floor.

As shown in FIGS. 4-8, the suction assembly, the first travelling assembly, and the window body cleaning system are disposed at the bottom of a body 101 of the window scrubbing device; the power output assembly extends out of the body 101 of the window scrubbing device. As the body 101 of the preferable window scrubbing device, it includes a first upper housing 1011 and a first lower housing 1012; the first upper housing 1011 and the first lower housing 1012 are surrounded together to form a receiving space inside the body 101 of the window scrubbing device; structures such as a first battery 108 and a mainboard 113 are disposed therein; the first upper housing 1011 and the first lower housing 1012 can be preferably detached from each other.

Figure 5:
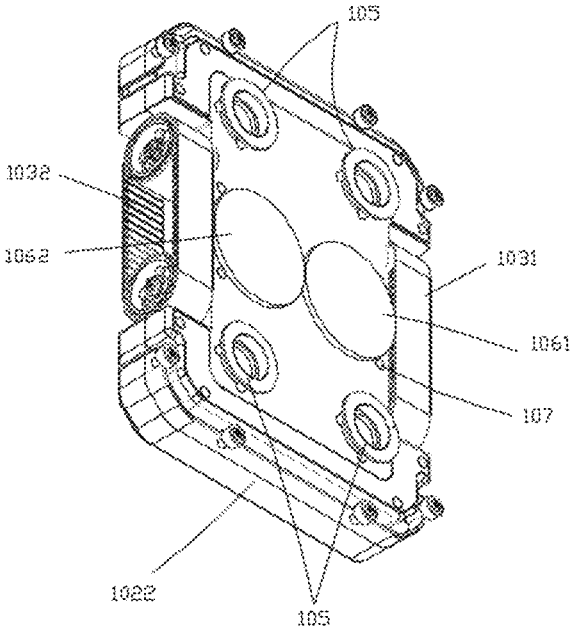
FIG. 5 is a second oblique view of the window scrubbing device in embodiments.
Figure 6:
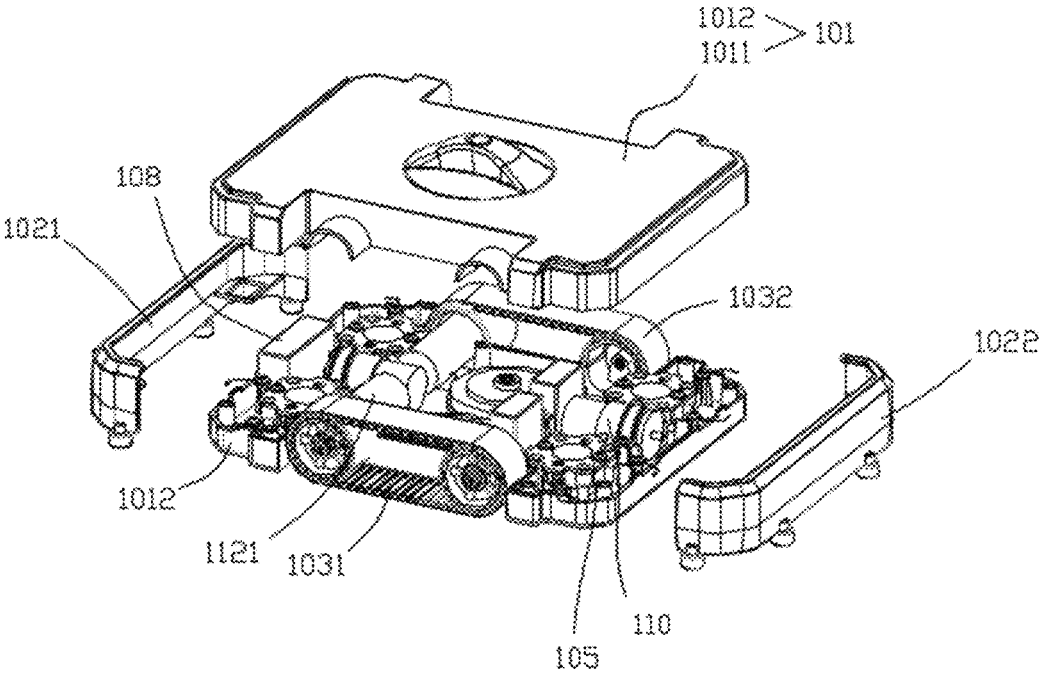
FIG. 6 is a first explosive view of a window scrubbing device in embodiments.

As a specific suction assembly, it includes a plurality of suction nozzles 105 distributed at the bottom of the body of the window scrubbing device; correspondingly, a negative pressure generation assembly 110 is disposed inside the body of the window scrubbing device; the negative pressure generation assembly 110 is separately connected to the suction nozzles 105 by means of pipelines, to generate a negative pressure between the window body to be wiped and the suction nozzles 105. Exemplarily, as shown in FIG. 5, the number of the suction nozzles 105 is 4; the plurality of the suction nozzles 105 are distributed at different positions, so as to more reliably ensure suction stability and prevent the body 101 of the window scrubbing device from being fallen from a surface of the window body.

An empty cavity of each of the suction nozzles 105 and a suction working plane constitute a vacuum negative pressure cross section with a fixed size area, and then adjusting a vacuum negative pressure degree can implement an adjustment of a pressing force degree made by the entire machine on the working plane; and adjusting the pressing force on the working plane to be not less than a minimum pressure of suction can implement the suction function of the entire machine.

As a preferable first travelling assembly, the first travelling assembly includes a first continuous track travelling mechanism 1031 and a second continuous track travelling mechanism 1032; and the first continuous track travelling mechanism 1031 and the second continuous track travelling mechanism 1032 are respectively located at two sides of the bottom of the body 101 of the window scrubbing device. Preferably, the first continuous track travelling mechanism 1031 and the second continuous track travelling mechanism 1032 have the same structure compositions and size standard; each of the specific structures thereof includes structures such as a continuous track, two or more continuous track wheels, and a spindle, which would not be further described in this embodiment.

A person skilled in the art can understood that, to drive the first travelling assembly, a first group of travelling drive assemblies are disposed inside the body 101 of the window scrubbing device. When the first travelling assembly includes the first continuous track travelling mechanism 1031 and the second continuous track travelling mechanism 1032, the first traveling drive assembly preferably includes the first traveling drive mechanism 1121 and the second traveling drive mechanism 1122; the first traveling drive mechanism 1121 is connected to and drives the first continuous track travelling mechanism 1031; and the second traveling drive mechanism 1122 is connected to and drives the second continuous track travelling mechanism 1032. Preferably, the first traveling drive mechanism 1121 and the second traveling drive mechanism 1122 have the same structure compositions and size standard; each of the specific structures thereof includes structures such as a drive motor, a reduction gearbox, and a transmission system; the drive motor generates an initial power; and after passing through the reduction gearbox, the transmission system of the traveling drive mechanism, and the spindle and the continuous track wheel of the continuous track travelling mechanism, the power is delivered to the continuous track, so that the continuous track rotates around the continuous track wheel, which would not be further described in this embodiment. The first travelling assembly includes the first continuous track travelling mechanism 1031 and the second continuous track travelling mechanism 1032 can bi-directionally rotate, respectively and separately and execute speed control, so as to implement functions such as turning, speeding up, and slowing down, so that the body 101 of the window scrubbing device travels on the working plane of the window body along a path scheduled in advance.

Figure 7:
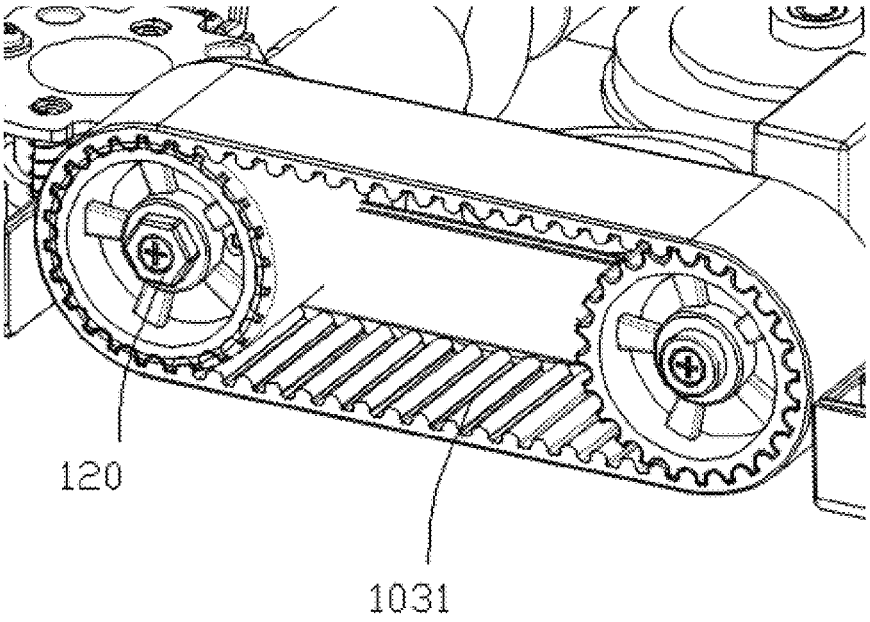
FIG. 7 is a partial enlarged view of a first continuous track travelling mechanism in FIG. 6.

When the first travelling assembly includes the first continuous track travelling mechanism 1031 and the second continuous track travelling mechanism 1032, preferably, the power output assembly includes output terminals 120 extending out from central shafts of respective continuous track wheels of the first continuous track travelling mechanism 1031 and the second continuous track travelling mechanism 1032; exemplarily, as shown in FIG. 7, the output terminal is a hexagonal cylinder with a preset length; in addition, it may further be a triangle, quadrilateral, pentagon, or other polygonal cylinder with a preset length.

As a preferable window body cleaning system, the window body cleaning system includes a first group of rotary cleaning rags and at least one first nozzle 107 disposed at the bottom of the body 101 of the window scrubbing device; a first water tank 104 is provided inside the body; and the first water tank 104 is connected to the first nozzle 107 by means of a pipeline. Exemplarily, as shown in FIG. 5, the number of the first nozzles is 4 and the first nozzles 107 are distributed at an edge of the rotary cleaning rag. It should be explained that for the number of the first nozzles 107 to be 4 is merely an example in this embodiment, and the number thereof may be 2, 4, or others. In this embodiment, the first nozzle 107 has a water spraying hole (not shown in the drawing), and the water spraying hole is communicated with the first water tank 104 by means of the pipeline.

Hence, during working, the window scrubbing device 10 can use a water spraying assembly for spraying a cleaning solution and supplementing the cleaning solution in time, so as to avoid that the cleaning rag is dried after being used for a period of time, so that the window scrubbing device 10 can continuously work for a long time; moreover, spraying the cleaning solution can increase a decontamination ability of the cleaning rag, and enhance a cleaning effect of the window scrubbing device 10. Moreover, the rotary cleaning rag can rotate independently, so as to further increase the decontamination ability.

Figure 4:
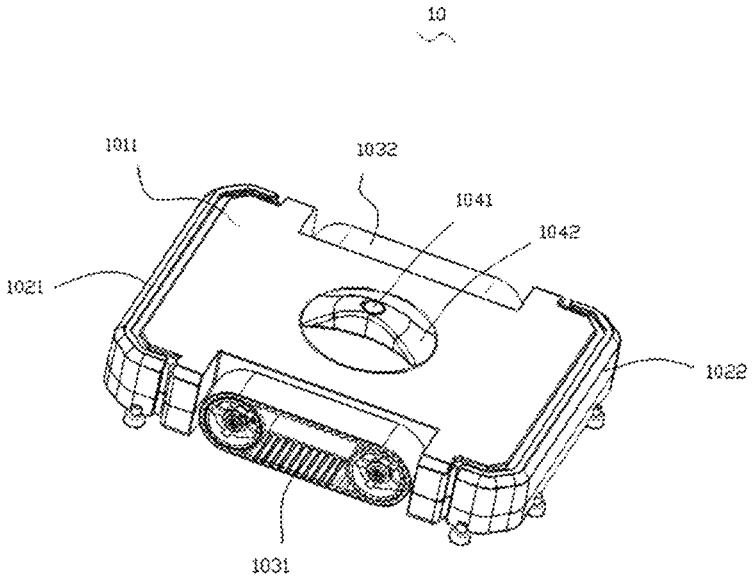
FIG. 4 is a first oblique view of a window scrubbing device in embodiments.
Figure 8:
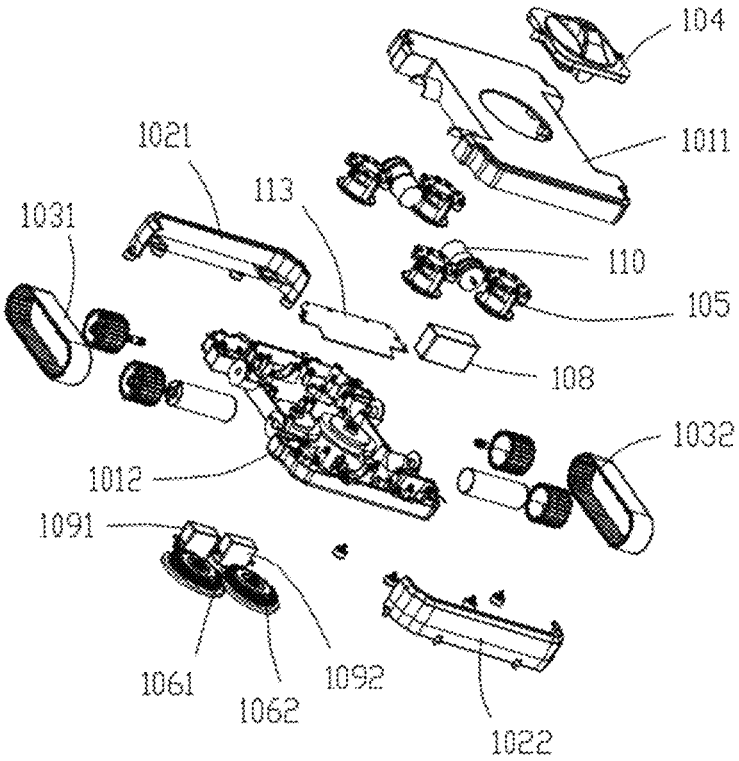
FIG. 8 is a second explosive view of the window scrubbing device in embodiments.
Figure 9:
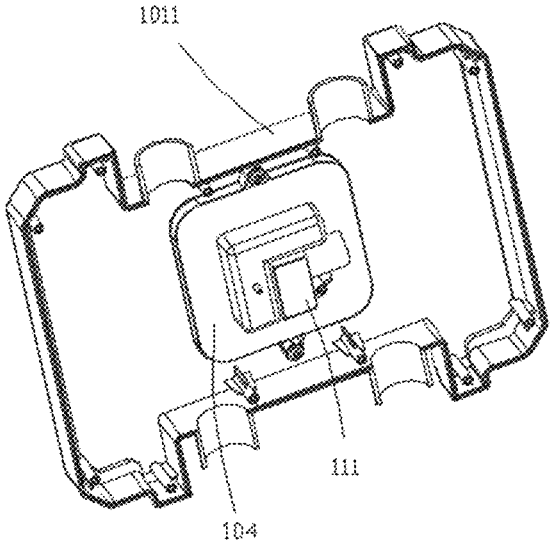
FIG. 9 is a schematic diagram of a first upper housing in embodiments.
Figure 10:
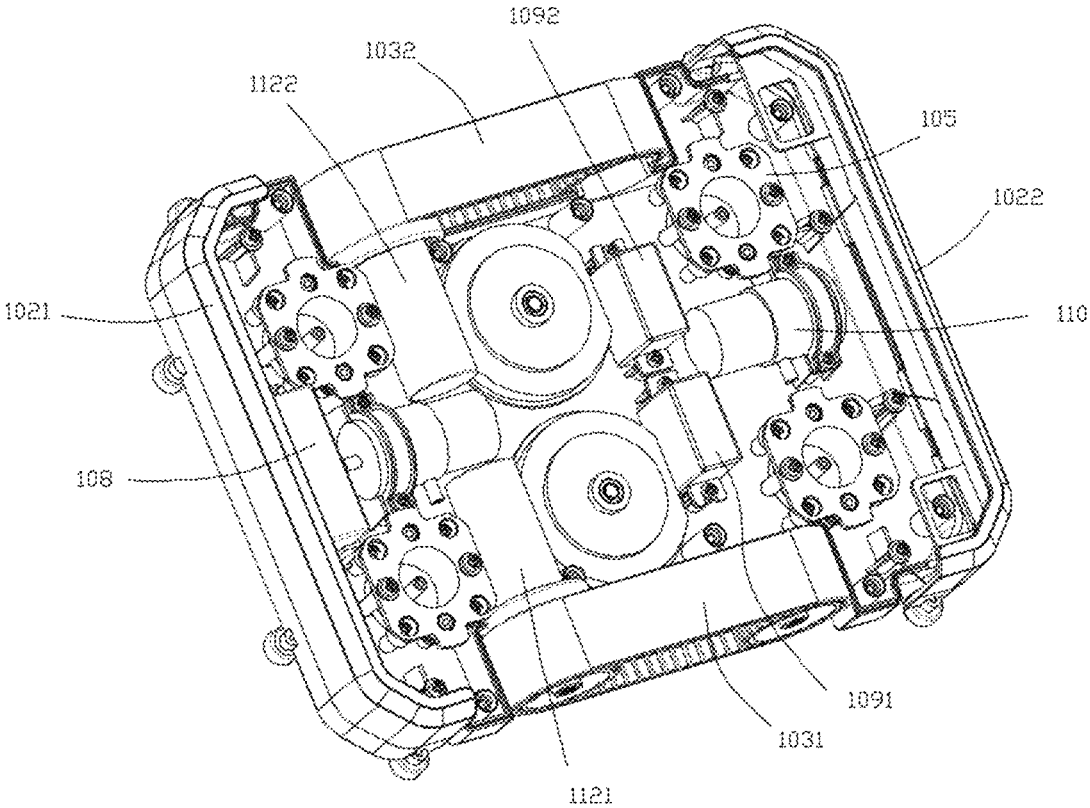
FIG. 10 is a schematic diagram of a first lower housing in embodiments.

Preferably, a water pump 111 is disposed inside the body 101 of the window scrubbing device; the water pump 111 is disposed between the first water tank 104 and the first nozzle 107, an is configured to pump water in the first water tank 104 to the water spraying assembly by means of the pipeline and then spray same. Specifically, as shown in FIGS. 4, 8, and 9, the first water tank 104 is mounted on the first upper housing 1011; the body of the first water tank 104 is located inside the first upper housing 1011; a water injection port cover 1041 of the first water tank 104 is located at an outer surface of the first upper housing 1011; a user can open the water injection port cover 1041 from the outside of the body 101 of the window scrubbing device, so as to facilitate to add the cleaning solution to the first water tank 104. The water pump 111 is disposed at a water outlet of the first water tank 104, to deliver the water in the first water tank 104 to the first nozzles 107 by means of the pipelines, then to be sprayed from the first nozzles 107. Preferably, a handle 1042 is integrally disposed on a water tank cover of the first water tank 104, so as to facilitate to open the water tank cover.

Figure 11:
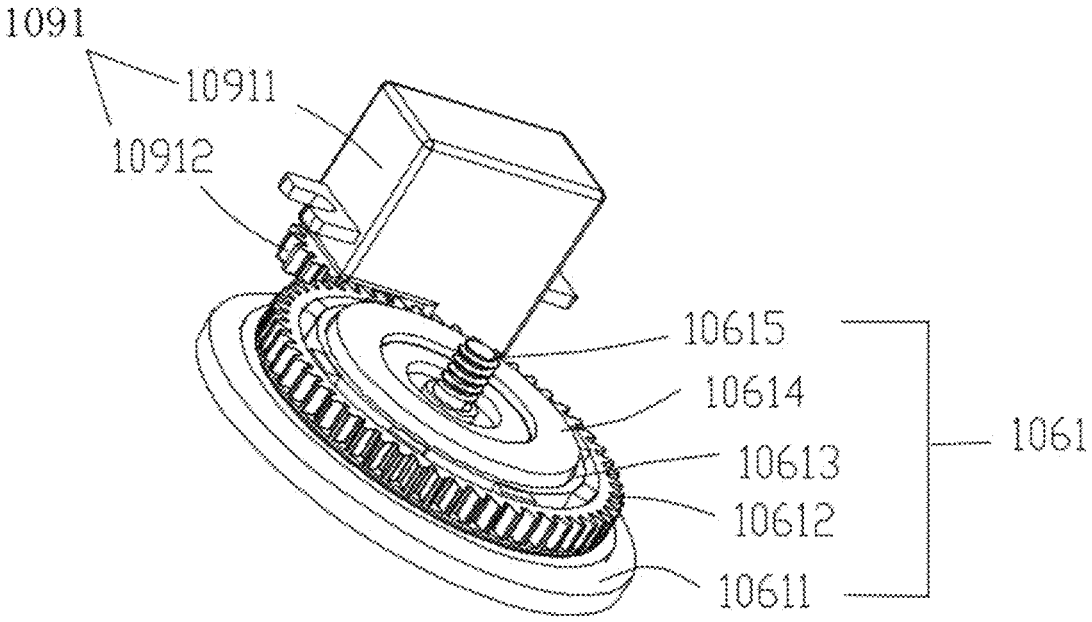
FIG. 11 is a schematic diagram of a combination body of a first cleaning rag drive and a first rotary cleaning rag in embodiments.
Figure 12:
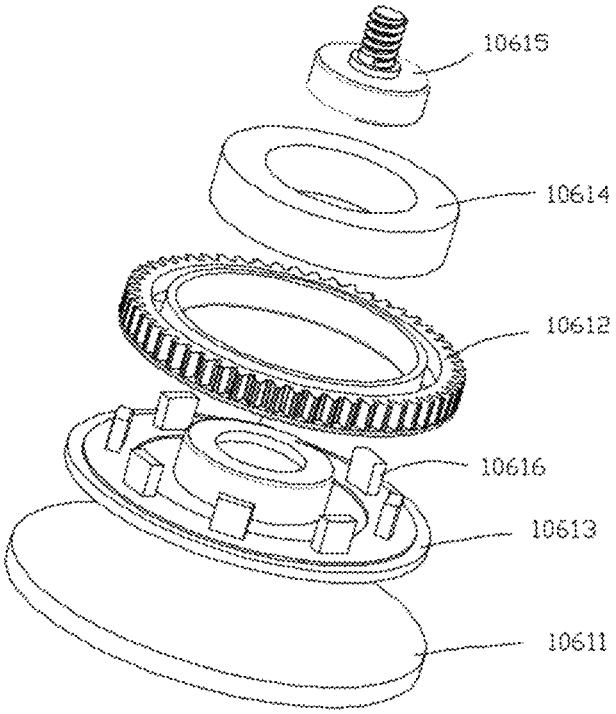
FIG. 12 is an explosive view of the first rotary cleaning rag in embodiments.
Figure 13:
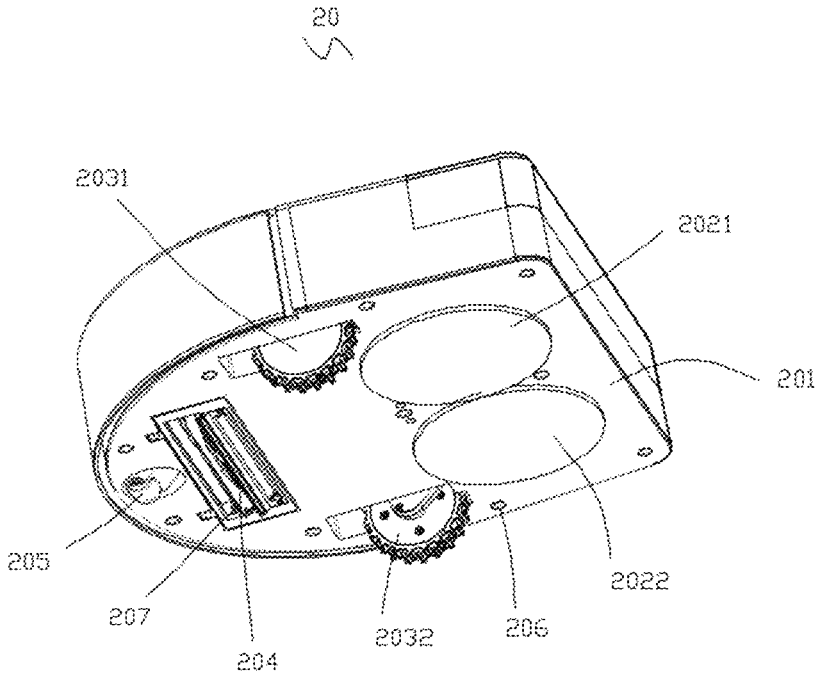
FIG. 13 is an oblique view of the floor scrubbing device in embodiments.

Preferably, as shown in FIGS. 5, 11, and 12, the number of the rotary cleaning rags in the first group of rotary cleaning rags is two, and the rotary cleaning rags are a first rotary cleaning rag 1061 and a second rotary cleaning rag 1062, respectively. The first rotary cleaning rag 1061 includes a first cleaning rag body 10611, a first turntable 10613, a first input gear 10612, and a first central shaft 10615; the first cleaning rag body 10611 is fixed outside a disc surface of the first turntable 10613; the first input gear 10612 is coaxially and fixedly sleeved on the first turntable 10613; the first central shaft 10615 is fixed on the body 101 of the window scrubbing device; the first turntable 10613 is coaxially and rotatably sleeved on the first central shaft 10615. The second rotary cleaning rag 1062 includes a second cleaning rag body, a second turntable, a second input gear, and a second central shaft; the second cleaning rag body is fixed outside a disc surface of the second turntable; the second input gear is coaxially and fixedly sleeved on the second turntable; the second central shaft is fixed on the body 101 of the window scrubbing device; the second turntable is coaxially and rotatably sleeved on the second central shaft. Correspondingly, a cleaning rag drive assembly is disposed in the body 101 of the window scrubbing device. Preferably, the cleaning rag drive assembly includes a first cleaning rag drive 1091 and a second cleaning rag drive 1902; the first cleaning rag drive 1091 is connected to and drives the first rotary cleaning rag 1061; the second cleaning rag drive 1092 is connected to and drives the first rotary cleaning rag 1062. Taking the first cleaning rag drive 1091 being connected to and driving the first rotary cleaning rag 1061 as an example, the first cleaning rag drive 1091 includes a first power box 10911 and a first output gear 10912; the first output gear 10912 is engaged with the first input gear 10612; power output by the first power box 10911 is delivered to the first input gear 10612 by means of the first output gear 10912.

Preferably, the shape and size of each composition members in the first rotary cleaning rag 1061 and the second rotary cleaning rag 1062 are the same, so as to improve the stability of the entire structure of the window scrubbing device 10, reduce part categories, and facilitate the maintenance.

Preferably, the rotary cleaning rag further includes a balance weight ring; as shown in FIGS. 11 and 12, in the first rotary cleaning rag 1061, a first balance weight ring 10614 is sleeved on the first turntable 10613.

Preferably, a first fixation cleaning rag (not shown in the drawing) is disposed at the bottom of the body 101 of the window scrubbing device. Preferably, the first fixation cleaning rag basically covers an entire bottom outer surface of the body 101 of the window scrubbing device. The first rotary cleaning rag 1061 and the second rotary cleaning rag 1062 can respectively rotate while wiping at the same time in respective opposite directions at the same rotation speed by means of the control of a control circuit assembly; by means of the control circuit assembly, the first water tank 104 periodically sprays, by means of nozzles, water spray of the cleaning solution to wet a working face dirt. The nozzles spray the cleaning solution; the first cleaning rag body 10611 and the second cleaning rag body rotates and wipes, and finally, the first fixation cleaning rag completely wipes so as to implement the cleaning and decontaminating function together.

Preferably, a barrier sense assembly is disposed on the body 101 of the window scrubbing device. As shown in the drawings such as FIGS. 4 and 6, the barrier sense assembly may include a first obstacle avoidance sense board 1021 and a second obstacle avoidance sense board 1022, respectively disposed at front and back sides of the body 101 of the window scrubbing device.

Preferably, a safety rope is further included (not shown in the drawing); one end of the safety rope is connected to the body 101 of the window scrubbing device, and the other end of the safety rope is connected to an external fixation structure. By tied by the safety rope, if an inevitable falling event occurs, no risk at all can also be ensured, and no occurrence of an accident would be caused.

Preferably, the second travelling assembly includes two or more roller modules; the roller module includes a roller body, a roller rack, and a transmission mechanism; the power input assembly is connected to and drives the roller module. Specifically, the two roller modules are a first roller module 2031 and a second roller module 2032, respectively; a guide wheel is disposed at a front side of the bottom of the body; the first roller module 2031 and the second roller module 2032 are disposed at a rear side of the bottom of the body.

In this embodiment, the first roller module 2031 and the second roller module 2032 preferably include the same structure composition and size, so as to facilitate mounting and movement control, and also to enable each member of the roller module to have good interchangeability, reduce the part categories, and facilitate the maintenance.

Taking the first roller module 2031 as an example, please referring to FIGS. 14-18 as well, it includes a roller body 20311, a roller rack 20312, and a transmission mechanism; the transmission mechanism is disposed in the roller rack 20312; a power input end of the transmission mechanism includes a power input shaft 203153; the power input shaft 203153 extends out of the roller rack 20312; and a power output end of the transmission mechanism supports, is connected to, and drives the roller body 20311. The power input assembly of the floor scrubbing device 20 is formed by a power input shaft 203153; an end surface of the power input shaft 203153 is provided with a connection recess 20314; and the connection recess 20314 is matched with the output terminal 120, and configured to mount the output terminal 120 and rotate with the output terminal 120.

Preferably, the first roller module 2031 further includes a fixation rack; the roller rack 20312 has a closed inner cavity; the transmission mechanism is disposed in the inner cavity of the roller rack 20312; the power input end of the transmission mechanism extends out from an upper side of the roller rack 20312; the power output end of the transmission mechanism extends out from a lower side of the roller rack 20312; the power output end of the transmission mechanism supports, is connected to, and drives the roller body 20311; an upper end of the roller rack 20312 elastically supports on the fixation rack 20313.

The roller rack 20312 can be formed by combining a first half housing 203121 and a second half housing 203122 in a box shape; the first half housing 203121 and the second half housing 203122 are detachably connected; when the two are fastened together, the roller rack 20312 formed by combining the first half housing 203121 and the second half housing 203122 has a closed inner cavity therein. Correspondingly, an upper side and a lower side of the roller rack 20312 are respectively provided with an opening, so that the power transmission shaft 203153 and the power output end of the transmission mechanism extend out from corresponding openings, respectively.

Preferably, a base passing through upper and lower, i.e., two ends, is disposed in the body; the roller rack 20312 is located in the base; the fixation rack 20313 is fixed at the top of the base. As a preferably fixation rack 20313, it is a flipped box shaped structure; when the fixation rack 20313 is flipped on the base, the base and the fixation rack 20313 form a closed space. Correspondingly, the fixation rack 20313 has an opening; the power input shaft 203153 can extends out from the opening.

Preferably, the transmission mechanism further includes a first rolling gear 203151, a second rolling gear 203152, and a rack transmission belt 203155; the power output end thereof includes a power output shaft 203154; two ends of the rack transmission belt 203155 are respectively engaged with the first rolling gear 203151 and the second rolling gear 203152; the first rolling gear 203151 is sleeved on the power input shaft 203153; the second rolling gear 203152 is sleeved on the power output shaft 203154; and the roller body 20311 is sleeved on the power output shaft 203154. Preferably, an end surface of one end of the power input shaft 203153 protruding outside the roller rack 20312 is provided with a connection recess 20314; the connection recess 20314 can be provided with structures such as a coupler or a transmission shaft, so as to introduce a drive force. Hence, when the power output shaft 203154 is driven by other power mechanisms, the power input shaft 203153 drives the first rolling gear 203151; the first rolling gear 203151 drives the second roller gear 203152 to rotate by means of the rack transmission belt 203155; the second rolling gear 203152 drives the power output shaft 203154 to rotate; the power output shaft 203154 drives the roller body 20311 to rotate; and finally, the roller body 20311 drives the body to move on the working face.

Preferably, the power input shaft 203153 is movably disposed through the roller rack 20312; a reset spring 203156 is sleeved on the power input shaft 203153; one end of the reset spring 203156 is abutted against the power input shaft 203153 and the other end of the reset spring 203156 is abutted against the roller rack 20312; and the reset spring 203156 elastically locks the power input shaft 203153 and the output terminals 120 when the window scrubbing device is mounted in the mounting recess 21.

In this embodiment, since the roller body 20311, the roller rack 20312, the fixation rack 20313, and the transmission mechanism are integrated as the roller module; in the roller module, the roller rack 20312 has a closed inner cavity; the transmission mechanism is disposed in the inner cavity of the roller rack 20312; the power input end of the transmission mechanism extends out from the upper side of the roller rack 20312; the power output end of the transmission mechanism extend out from the lower side of the roller rack 20312; the power output end supports, is connected to, and drives the roller body 20311. Hence, for rubbish particles to jam and damage the transmission mechanism can be prevented; moreover, the integral roller module is neater regarding the body, reduces the occupied space more, is easy to be maintained, and improves user experience. Preferably, an upper end of the roller rack 20312 is elastically supported by a vertical damper 20316 on the fixation rack 20313; a lower end of the vertical damper 20316 is provided with a mounting hole 203163; and the power input shaft 203153 is slidably disposed through the mounting hole 203163. As a preferable vertical damper 20316, it includes a vertical support arm 203161 and a vertical spring 203162; the vertical support arm 203161 is fixed in or abutted against a corresponding mounting base in the fixation rack 20313; a lower end of the vertical support arm 203161 is provided with the mounting hole 203163; the power input shaft 203153 is slidably disposed through the mounting hole 203163; two ends of the vertical spring 203162 can be respectively abutted against the fixation rack 20313 and the power input shaft 203153. As an implementation mode for sliding, the length of the mounting hole 203163 is greater than the maximum outer diameter of the power input shaft 203153 therein, so that the power input shaft 203153 disposed through the mounting hole 203163 can slide upwards and downwards. Hence, when a vibration impact occurs in a vertical direction, the vertical damper 20316 can function as damping vibrations.

Preferably, the upper end of the roller rack 20312 is further elastically supported by a transverse damper 20317 on the fixation rack 20313; two ends of the transverse damper 20317 are respectively connected to the roller rack 20312 and the fixation rack 20313, configured to damp vibrations when the roller rack 20312 swings in a transverse direction. As a preferable transverse damper 20317, it consists of a transversally disposed spring; both ends of the spring are respectively connected to the fixation rack 20313 and the roller rack 20312; when a transverse vibration impact occurs, the transverse damper 20317 can function as damping vibrations.

Moreover, the vertical damper 20316 and the transverse damper 20317 can both work independently and cooperatively, for example, when the roller rack 20312 swings, the two work at the same time. Hence, the upper end of the roller rack 20312 is supported on the fixation rack 20313 so that the vibration impact on the body is reduced when passing through an obstacle or an uneven working face.

Preferably, the second travelling assembly further includes a guide wheel 205; the guide wheel 205 is disposed at a guide wheel recess 210 in front of the bottom of the body 201 of the floor scrubbing device; the guide wheel 205 has a turning capability, which is preferably an omni-directional wheel. The roller bodies and guide wheels 205 in the first and second roller modules form a stable three-point support, which can ensure the stability of travelling of the floor scrubbing device 20. The roller bodies in the first and second roller modules can respectively rotate in both directions; control processing of the control circuit assembly of the floor scrubbing device 20 is used for coordinating and unifying each rotation speed and turning direction, to finally implement the travelling direction, travelling speed, and travelling route of the entire machine together.

Preferably, as shown in FIGS. 13-26, the floor cleaning system includes a rolling brush 204, a second group of rotary cleaning rags, and a second nozzle 206; a rolling brush drive 209, a second group of cleaning rag drive assemblies, a rubbish box 212, and a second water tank are disposed inside the body 201 of the floor scrubbing device; the rolling brush drive 209 is connected to and drives the rolling brush 204; the second group of cleaning rag drive assemblies is connected to and drive the second group of rotary cleaning rags; the second water tank is communicated with the second nozzle 206 by means of a pipeline; the rolling brush 204 is closer to the front of the forwarding direction of the roller module than the second group of cleaning rag drive assemblies; and the rubbish box 212 is in butt joint with the rolling brush 204 to receive and store rubbish from the rolling brush 204.

The body 201 of the floor scrubbing device is a body member of the floor scrubbing device 20; as a preferable body 201 of the floor scrubbing device, it includes a second upper housing 2012 and a bottom plate 2011; the second upper housing 2012 and the bottom plate 2011 surround together to form a receiving space inside the body 201 of the floor scrubbing device; structures such as a second battery 208 and a mainboard are disposed therein; the second upper housing 2012 and the bottom plate 2011 is preferably detachable.

Preferably, the bottom of the body 201 of the floor scrubbing device has a rolling brush recess 211 recessed towards an inner side; the shape of the rolling brush recess 211 is preferably an arc shape; and the rolling brush 204 is disposed in the rolling brush recess 211. The rolling brush recess 211 has a rubbish outlet; the rubbish outlet faces towards the inner of the body 201 of the floor scrubbing device; when the rolling brush 204 rotates, rubbish particles raised by the rolling brush 204 would move in the rolling brush recess 211 along with the rolling brush 204; when moving to the rubbish outlet, under the function of a centrifugal force, the rubbish are tossed out from the rolling brush recess 211 by means of the rubbish outlet. Preferably, a recess opening of the rolling brush recess 211 is provided with a rolling brush cover 207; the rolling brush cover 207 can cover a part of the rolling brush 204; and the rolling brush cover 207 is detachably connected to an outer edge of a recess wall of the rolling brush recess 211, so that the rolling brush 204 can be conveniently cleaned or changed.

The rubbish box 212 is provided with a rubbish inlet; the rubbish outlet is communicated with the rubbish inlet. Hence, after the rubbish are tossed out from the rolling brush recess 211 by means of the rubbish outlet under the function of the centrifugal force, they can enter the rubbish box 212 from the rubbish inlet. Preferably, a box door 2124 that can close the rubbish inlet is disposed at an inner side of the rubbish inlet. The setting of the box door 2124 enables the rubbish inlet is opened only when the rolling brush 204 rotates, so as to avoid the exposure of the rubbish in the rubbish box 212 by the rubbish inlet in a non-working state.

As a preferable rubbish box 212, the rubbish box 212 includes a box body 2121 and a box cover 2122; the rubbish inlet is disposed on the box body 2121; the box cover 2122 can rotatably disposed on the box body 2121; a lock catch 2123 is disposed between the box cover 2122 and the box body 2121. Since the box cover 2122 is rotatably disposed on the box body 2121, a user or a maintenance stuff can open the box cover 2122 on the box body 2121, to facilitate to clean the rubbish in the rubbish box 212. Since the lock catch 2123 is disposed between the box cover 2122 and the box body 2121, the box cover 2122 on the box body 2121 is only opened under a permitted condition. Preferably, a rubbish box handle 2125 is disposed on the box body 2121, to facilitate the user or maintenance stuff to move the rubbish box 212.

Preferably, the second group of rotary cleaning rag assemblies includes a plurality of rotation rags; the second group of cleaning rag drive assemblies includes a plurality of cleaning rag drives; the number of the cleaning rag drives equals to the number of the rotary cleaning rags and they are in one-to-one correspondence; the cleaning rag drive includes a drive box and an output gear; and the output gear is engaged with the input gear.

Further preferably, the number of the rotary cleaning rags in the second group of rotary cleaning rags is 2, and the rotary cleaning rags are a third rotary cleaning rag 2021 and a fourth rotary cleaning rag 2022, respectively; taking the third rotary cleaning rag 2021 as an example, the third rotary cleaning rag 2021 includes a third cleaning rag body 20211, a third turntable 20212, a third input gear 20213, and a third central shaft 20215; the third cleaning rag body 20211 is fixed outside a disc surface of the third turntable 20212; the third input gear 20213 is coaxially and fixedly sleeved on the third turntable 20212; the third central shaft 20215 is fixed on the body 201 of the floor scrubbing device; and the third turntable 20212 is coaxially and rotatably sleeved on the third central shaft 20215. Correspondingly, the cleaning rag drive assembly includes a third cleaning rag drive 2131 and a fourth cleaning rag drive 2132; the third cleaning rag drive 2131 is connected to and drives the third rotary cleaning rag 2021; the fourth cleaning rag drive 2132 is connected to and drives the second cleaning rag drive 1902. Taking the third cleaning rag drive 2131 being connected to and driving the third rotary cleaning rag 2021 as an example, the third cleaning rag drive 2131 includes a third power box and a third output gear; the third output gear is engaged with the third input gear 20213; power output by the third power box is delivered to the third input gear 20213 by means of the third output gear.

Preferably, the shape and size of each composition members in the third rotary cleaning rag 2021 and the fourth rotary cleaning rag 2022 are the same, so as to improve the stability of the entire structure of the floor scrubbing device 20, reduce part categories, and facilitate the maintenance.

Figure 14:
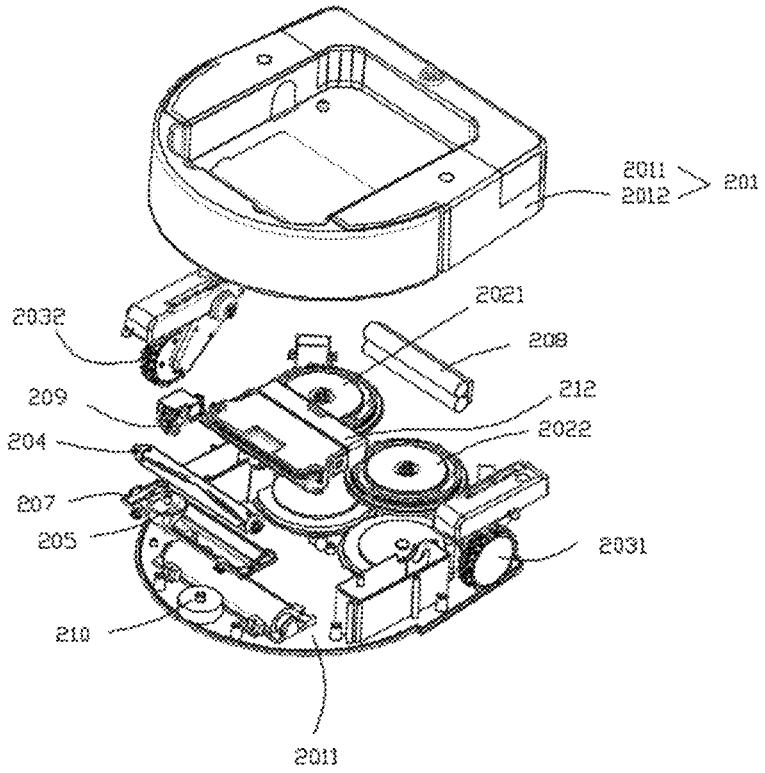
FIG. 14 is a first explosive view of the floor scrubbing device in embodiments.
Figure 15:
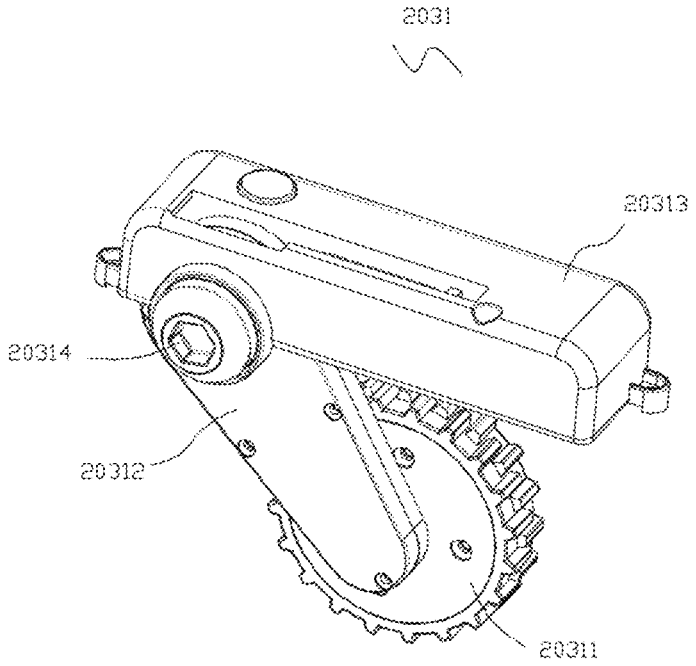
FIG. 15 is an oblique view of a first roller module in embodiments.
Figure 16:
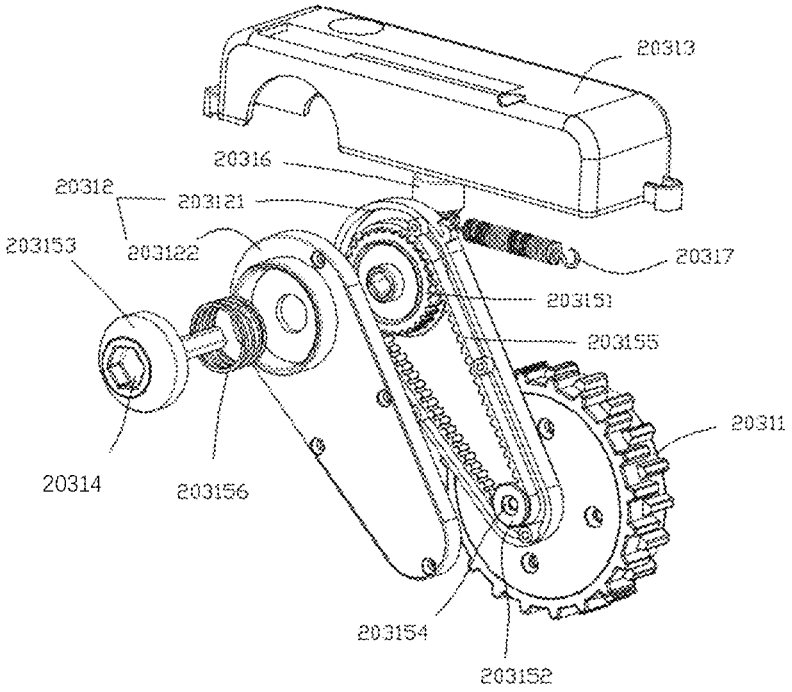
FIG. 16 is a first explosive view of the first roller module in embodiments.
Figure 17:
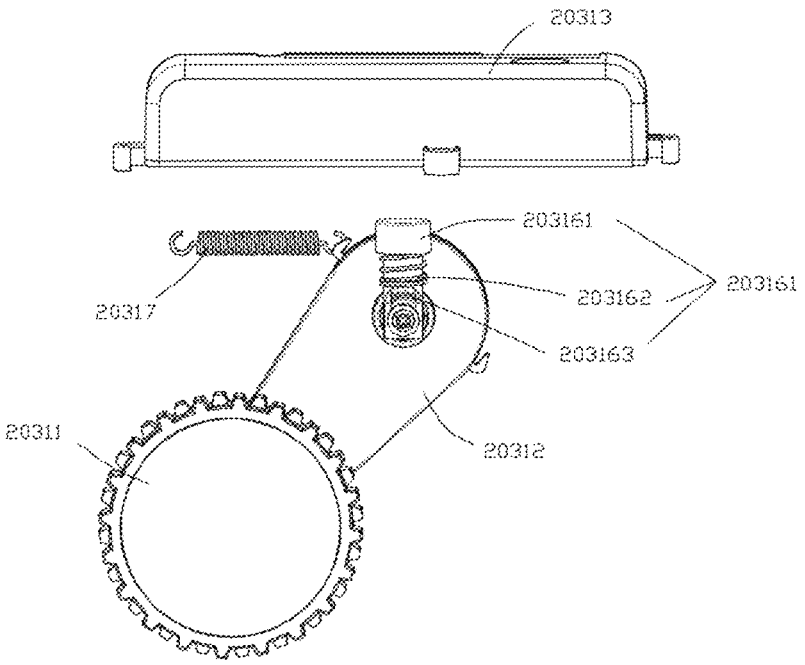
FIG. 17 is a second explosive view of the first roller module in embodiments.
Figure 18:
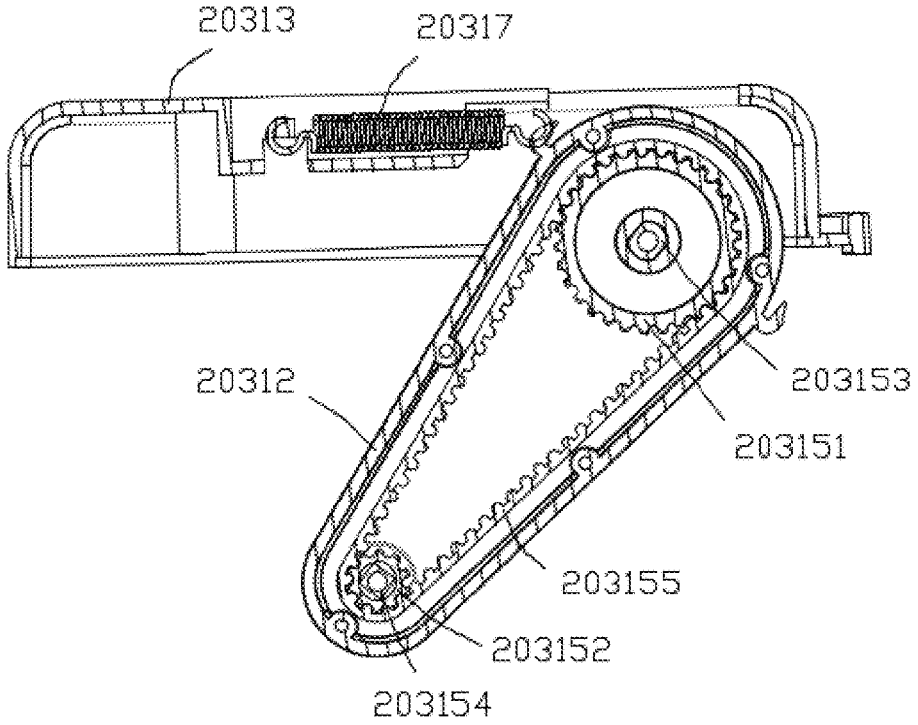
FIG. 18 is a section view of the first roller module in embodiments.
Figure 19:
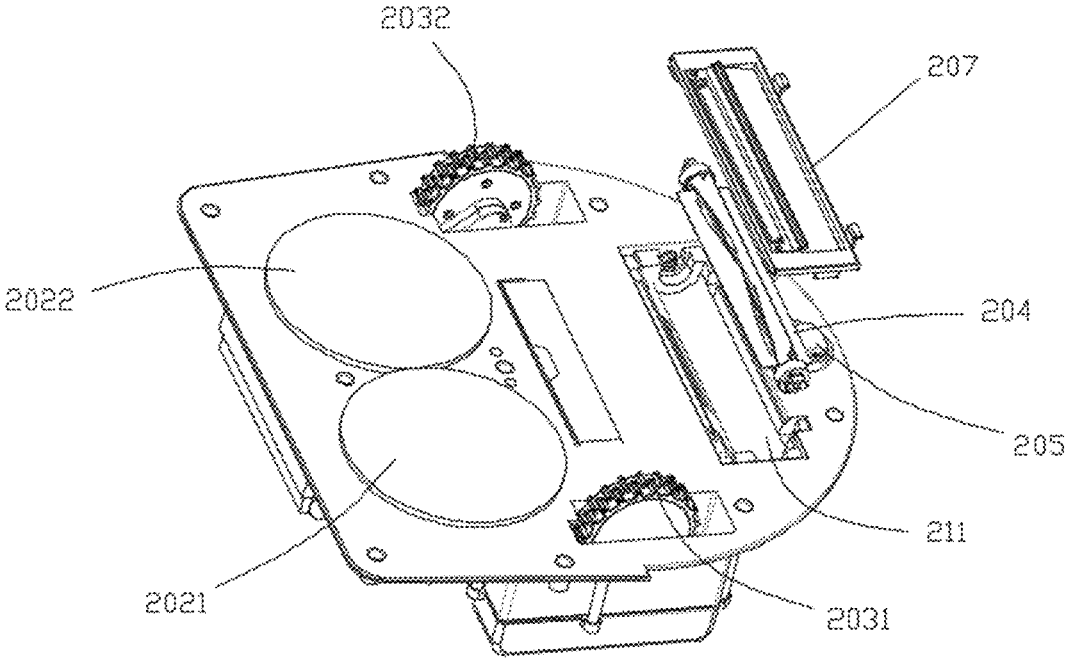
FIG. 19 is a second explosive view of the floor scrubbing device in embodiments.
Figure 20:
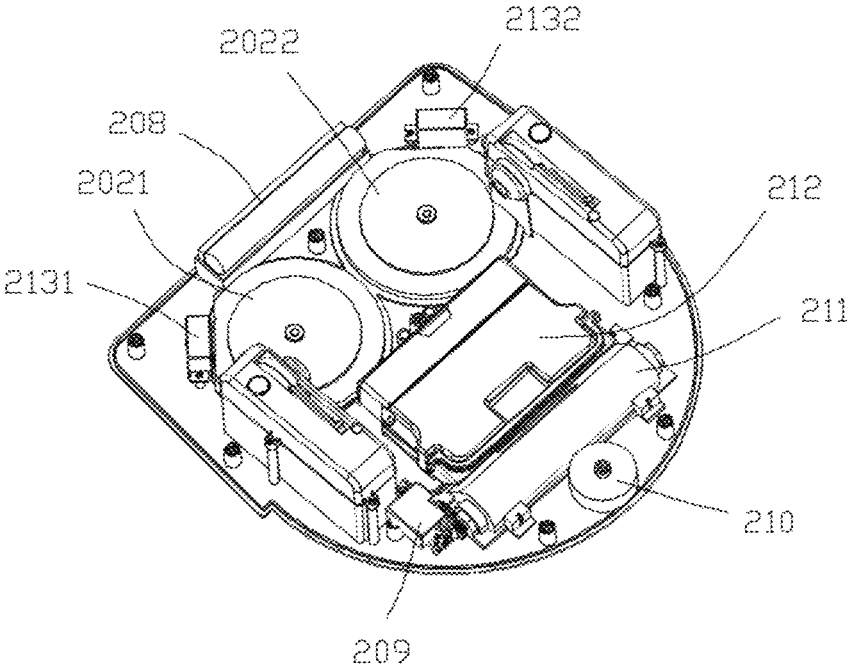
FIG. 20 is a schematic diagram of each member on a bottom plate in embodiments.
Figure 21:
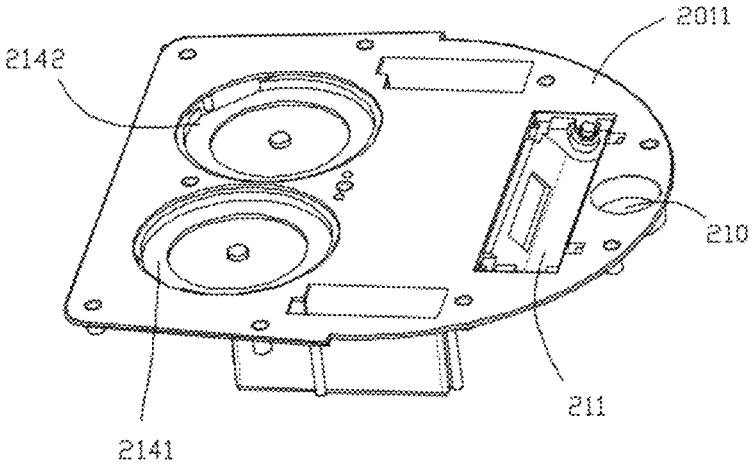
FIG. 21 is a schematic diagram of the bottom plate in embodiments.
Figure 22:
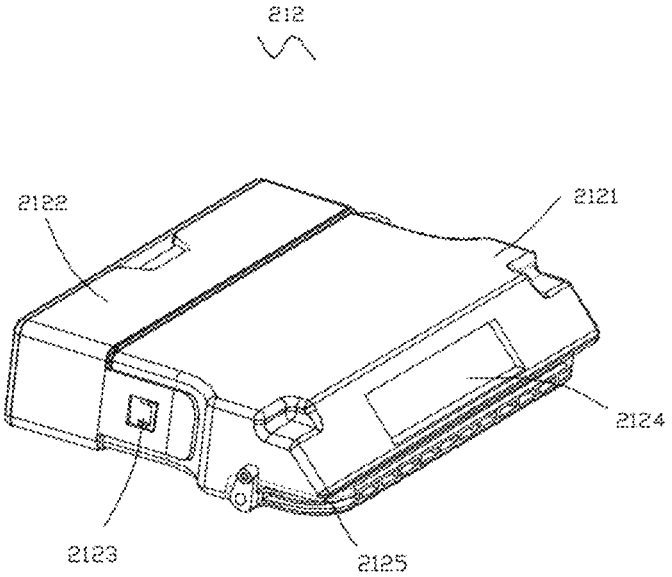
FIG. 22 is a schematic diagram of a rubbish box in embodiments.
Figure 23:
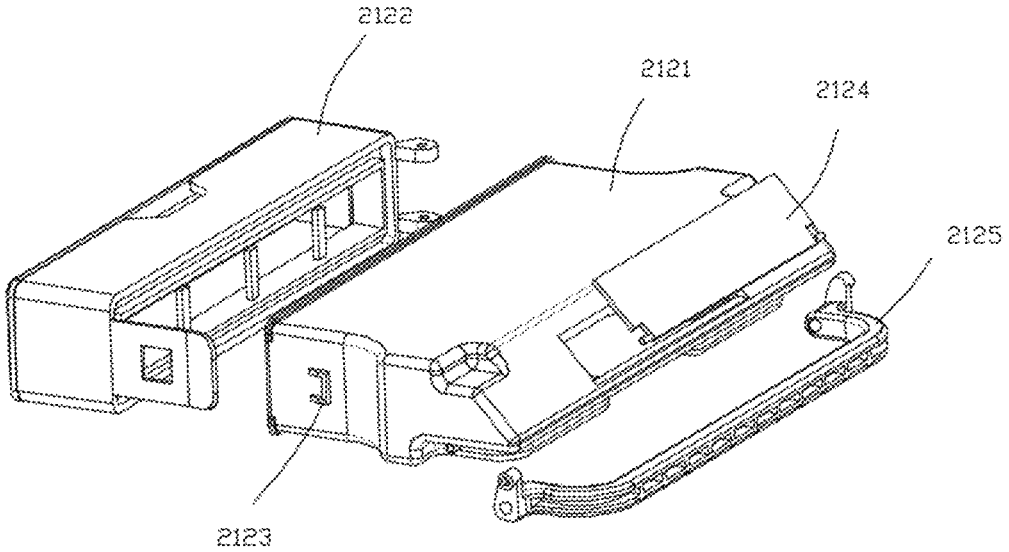
FIG. 23 is a schematic diagram of the combination body of the first cleaning rag drive and the first rotary cleaning rag in embodiments.
Figure 24:
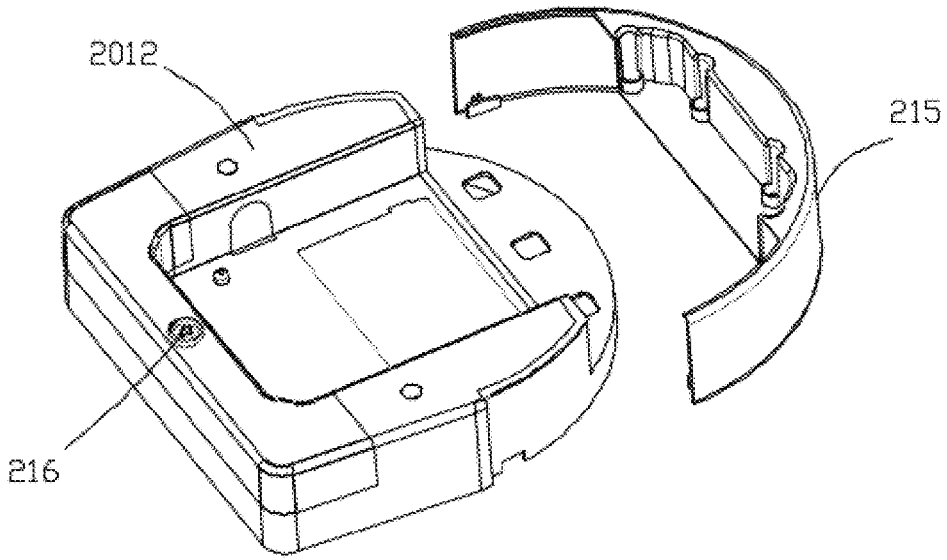
FIG. 24 is a schematic diagram of an upper housing and an obstacle avoidance sense board in embodiments.
Figure 25:
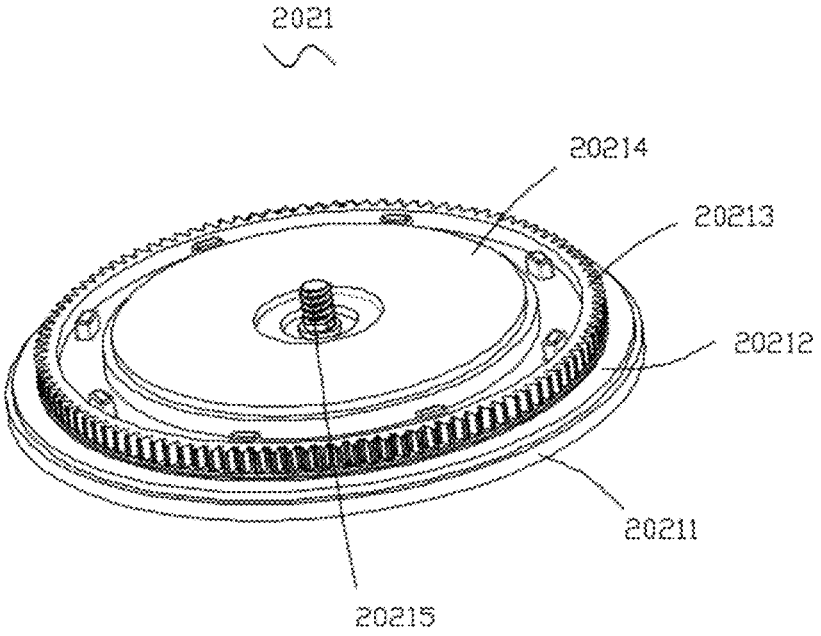
FIG. 25 is a schematic diagram of the first rotary cleaning rag in embodiments.
Figure 26:
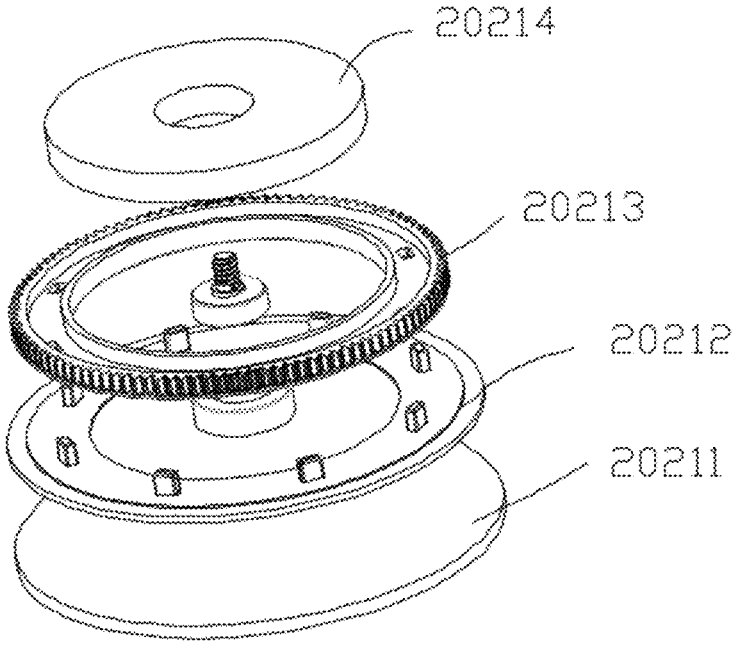
FIG. 26 is an explosive view of the first rotary cleaning rag in embodiments.

Preferably, the rotary cleaning rag assembly further includes a balance weight ring; as shown in FIGS. 14 and 15, in the third rotary cleaning rag 2021, a first balance weight ring 20214 is sleeved on an inner side of the first input gear 20213.

Preferably, the bottom of the body 201 of the floor scrubbing device has a cleaning rag recess recessed inwards; the turntable and input gear are located in the cleaning rag recess. A back surface of a cleaning rag body covers an outer edge of the recess opening of the cleaning rag recess, so that the back surface of the cleaning rag body can seal the cleaning rag recess. A notch is provided at a recess wall of the cleaning rag recess; an outer edge of the input gear exposes the notch, so that the input gear can be engaged with the output gear. Exemplarily, when the number of the rotary cleaning rags is 2, and the rotary cleaning rags are a third rotary cleaning rag 2021 and a fourth rotary cleaning rag 2022, respectively, the cleaning rag recess are a third cleaning rag recess 2141 and a fourth cleaning rag recess 2142, respectively.

Preferably, the number of the second nozzles 206 is greater than one; a water outlet is disposed below the second water tank; the water outlet is communicated to the second nozzles 206 by means of the pipeline. Specifically, the second water tank is integrated in the second upper housing 2012; a second water injection port cover 216 of the water tank is located at an outer surface of the second upper housing 2012; the user can open the second water injection port cover 216 from the outside of the body 201 of the floor scrubbing device, so as to facilitate to add water to the second water tank. The bottom of the water tank has one or more water outlets, to deliver the cleaning solution in the water tank to the nozzle 206 after passing through the water outlet by means of the pipeline, and then to be injected from the nozzle 206.

In this embodiment, the third rotary cleaning rag 2021 and the fourth rotary cleaning rag 2022 can respectively rotate while wiping at the same time in respective opposite directions at the same rotation speed by means of the control of a control circuit assembly; by means of the control circuit assembly, the second water tank periodically sprays, by means of nozzles, water spray of the cleaning solution to wet a working face dirt. The second nozzle 206 sprays the cleaning solution; the third cleaning rag body 20211 and the fourth cleaning rag body rotate while wiping. Hence, when the floor scrubbing device 20 is working, the rolling brush 204 and the rubbish box 212 cooperate to implement pre-cleaning of hair debris and large particle rubbish; the water spraying assembly sprays the cleaning solution to wet the working face; when the rotary cleaning rag assembly rotates, the dirt on the working face is completely erased, so that the cleaning capability of the floor scrubbing device 20 is remarkably improved.

Preferably, a second fixation cleaning rag (not shown in the drawing) is disposed at the bottom of the body 201 of the floor scrubbing device. Preferably, the second fixation cleaning rag basically covers an entire bottom outer surface of the body 201 of the floor scrubbing device. In this way, the rolling brush 204 cleans in advance, the water spraying assembly sprays the cleaning solution for wetting, the rotary cleaning rag assembly rotates while wiping, and finally the fixation cleaning rag completely wipes; the full process omni-directionally, effectively, and completely removes dirt.

Preferably, a barrier sense assembly is also disposed on the body 201 of the floor scrubbing device, configured to sense an obstacle in front of the floor scrubbing device 20. The barrier sense assembly of the floor scrubbing device may include a third obstacle avoidance sense board 215; the third obstacle avoidance sense board 215 is mounted in front of the second upper housing 2012, and is used as a part of the second upper housing 2012. By means of the control processing of the third obstacle avoidance sense board 215 assembly and the control circuit assembly of the floor scrubbing machine, the rotation speed and turning of a first driver wheel 2031 and a second driver wheel 2032 are coordinated and unified, to finally implement the travelling direction, travelling speed, and travelling route of the entire machine together.

Preferably, an ejection mechanism is disposed between the window scrubbing device 10 and the floor scrubbing device 20 for ejecting the window scrubbing device from the mounting recess when a locking mechanism is disabled. Since the ejection mechanism is disposed, when a locking mechanism is disabled, the ejection mechanism can automatically eject the window scrubbing device from the mounting recess to facilitate the user to take out the window scrubbing device 10 and to improve the user experience.

Figure 3:
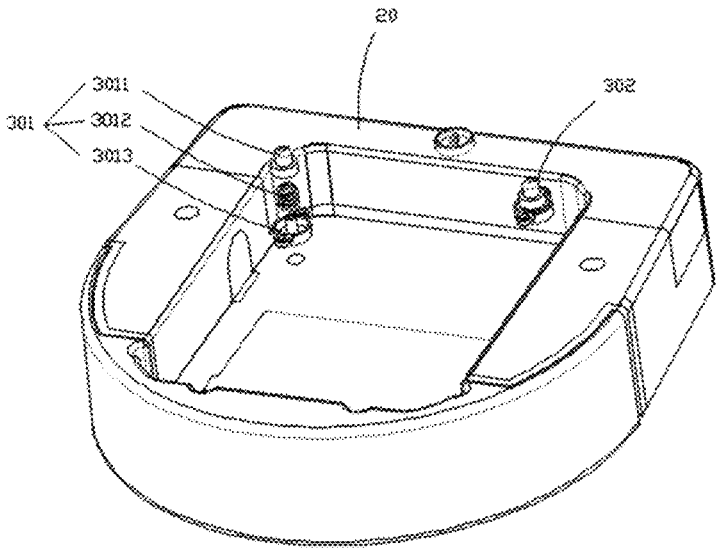
FIG. 3 is a first explosive view of a floor scrubbing device in embodiments.

As a preferable ejection mechanism, the ejection mechanism is mounted on the floor scrubbing device, the number thereof may be greater than one, and as shown in FIG. 3, the number thereof is 2; the ejection mechanisms are a first ejection mechanism 301 and a second ejection mechanism 302, respectively, and distributed at different positions of the recess bottom of the mounting recess 21, and the structure compositions thereof are the same. Taking the first ejection mechanism 301 as an example, it includes a first mounting base 3013, a first ejection spring 3012, and a first movable post 3011; two ends of the first ejection spring 3012 are respectively abutted against the first mounting base 3013 and the first movable post 3011; the first mounting base 3013 is fixed inside the body 201 of the floor scrubbing device; the first movable post 3011 includes a first section having a large diameter and a first section having a small diameter; a through hole communicated with the interior of the body 201 of the floor scrubbing device is disposed at the bottom of the mounting recess 21; the diameter of the through hole is greater than the diameter of the first section having a small diameter but less than the diameter of the first section having a large diameter; the first section having a small diameter is disposed through the through hole; and the head of the first section having a small diameter is abutted against the bottom of the body 101 of the window scrubbing device.

At least one of a posture detection unit, a pressure detection unit, or a photoelectric detection unit (not shown in the drawings) is disposed inside the body 201 of the floor scrubbing device; and the posture detection unit, the pressure detection unit, and the photoelectric detection unit are respectively configured to detect a position state of the window scrubbing device with respect to the floor scrubbing device. Specifically, the posture detection unit includes a pressure sense sensor, a gyroscope, or the like in the body 201 of the floor scrubbing device; according to a change of center of gravity and a change of angles, the position state of the window scrubbing device 10 with respect to the floor scrubbing device 20 is determined; for the working principle of the posture detection unit per se, this embodiment would not further explained. For the pressure detection unit, a stress sensor can be set at one or more positions of the mounting recess; according to a result fed back by the stress sensor, the position state of the window scrubbing device 10 with respect to the floor scrubbing device 20 is determined, for example, whether to be embedded in the mounting recess. For the photoelectric detection unit, a photoelectric sensor can be set at one or more positions of the mounting recess, for example a light emitting diode type; the position state of the window scrubbing device 10 with respect to the floor scrubbing device 20 is detected, for example, whether to be embedded in the mounting recess.

The disclosures above are merely several specific implementing scenes of the present invention, however, the present invention is not limited thereto; any change that could be conceived of by a person skilled in the art should fall within the scope of protection of the present invention.

What is claimed is:

1. A scrubbing robot, comprising:

a window scrubbing device, comprising a window body cleaning system, a suction assembly configured to be sucked to a window body, and a first travelling assembly configured to move on the window body; and a floor scrubbing device, comprising a floor cleaning system and a second travelling assembly configured to move on a floor, wherein the body of the floor scrubbing device has a mounting recess, and the window scrubbing device is configured to be embedded into and removed from the mounting recess, wherein the window scrubbing device further comprises a power output assembly;

the floor scrubbing device further comprises a power input assembly;

the power output assembly is connected to and drives the power input assembly; and the power input assembly is connected to and drives the second travelling assembly, so that the second travelling assembly is driven by the window scrubbing device to drive the floor scrubbing device to move on the floor.

2. The scrubbing robot according to claim 1, wherein the window body cleaning system comprises a first group of rotary cleaning rags and at least one first nozzle disposed at a bottom of a body of the window scrubbing device; a first water tank is provided inside the body of the window scrubbing device; and the first water tank is connected to the first nozzle by means of a pipeline.

3. The scrubbing robot according to claim 1, wherein the first travelling assembly comprises a first continuous track travelling mechanism and a second continuous track travelling mechanism; and the first continuous track travelling mechanism and the second continuous track travelling mechanism are respectively located at two sides of the bottom of the body of the window scrubbing device.

4. The scrubbing robot according to claim 3, wherein the second travelling assembly comprises two or more roller modules; and the power input assembly is connected to and drives the roller modules.

5. The scrubbing robot according to claim 4, wherein the roller module comprises a roller body, a roller rack, and a transmission mechanism; the transmission mechanism is disposed in the roller rack; a power input end of the transmission mechanism comprises a power input shaft; the power input shaft extends out of the roller rack; and a power output end of the transmission mechanism supports, is connected to, and drives the roller body.

6. The scrubbing robot according to claim 5, wherein the power output assembly comprises output terminals extending out from central shafts of respective continuous track wheels of the first continuous track travelling mechanism and the second continuous track travelling mechanism; the power input assembly is formed by the power input shaft; an end surface of the power input shaft is provided with a connection recess; and the connection recess is matched with the output terminal, and is configured to mount the output terminal and rotate with the output terminal.

7. The scrubbing robot according to claim 6, wherein the power input shaft is movably disposed through the roller rack; a reset spring is sleeved on the power input shaft; one end of the reset spring is abutted against the power input shaft and the other end thereof is abutted against the roller rack; and the reset spring elastically locks the power input shaft and the output terminals when the window scrubbing device is mounted in the mounting recess.

8. The scrubbing robot according to claim 6, wherein the output terminal and the power input shaft are configured to have conductive properties.

9. The scrubbing robot according to claim 6, wherein the output terminal and the power input shaft both have an inner through hole through which a cable can be disposed therebetween.

10. The scrubbing robot according to claim 5, wherein the transmission mechanism comprises a first rolling gear, a second rolling gear, and a rack transmission belt; the power output end comprises a power output shaft; two ends of the rack transmission belt are respectively engaged with the first rolling gear and the second rolling gear; the first rolling gear is sleeved on the power input shaft; the second rolling gear is sleeved on the power output shaft; and the roller body is sleeved on the power output shaft.

11. The scrubbing robot according to claim 5, wherein a limiting mechanism is disposed between the window scrubbing device and the floor scrubbing device; the limiting mechanism comprises a plurality of locking posts located at a periphery of the bottom of the body of the window scrubbing device and a plurality of limiting grooves located at a periphery of a recess wall of the mounting recess; and the plurality of locking posts are adopted into the plurality of limiting grooves to prevent movement of the window scrubbing device in a horizontal direction.

12. The scrubbing robot according to claim 1, wherein the floor cleaning system comprises a rolling brush disposed at a bottom of the body of the floor scrubbing device, a second group of rotary cleaning rags, and at least one second nozzle; a rubbish box and a second water tank are disposed inside the body of the floor scrubbing device; the second water tank is communicated with the second nozzle by means of a pipeline; and the rubbish box is in a butt joint with the rolling brush to receive and store rubbish from the rolling brush.

13. The scrubbing robot according to claim 1, wherein the window body cleaning system further comprises a first fixed cleaning rag disposed at a bottom of a body of the window scrubbing device.

14. The scrubbing robot according to claim 1, wherein the floor cleaning system further comprises a second fixed cleaning rag disposed at a bottom of the body of the floor scrubbing device.

15. The scrubbing robot according to claim 1, wherein at least one of a posture detection unit, a pressure detection unit, or a photoelectric detection unit is disposed inside the body of the floor scrubbing device; and the posture detection unit, the pressure detection unit, and the photoelectric detection unit are respectively configured to detect a position state of the window scrubbing device with respect to the floor scrubbing device.

16. A scrubbing robot, comprising:

a window scrubbing device, comprising a window body cleaning system, a suction assembly configured to be sucked to a window body, and a first travelling assembly configured to move on the window body; and a floor scrubbing device, comprising a floor cleaning system and a second travelling assembly configured to move on a floor, wherein a body of the floor scrubbing device has a mounting recess, and the window scrubbing device is configured to be embedded into and removed from the mounting recess, wherein an ejection mechanism is disposed between the window scrubbing device and the floor scrubbing device; and the ejection mechanism is configured to eject the window scrubbing device from the mounting recess when a locking mechanism is disabled.

17. The scrubbing robot according to claim 16, wherein an ejection device is mounted on the floor scrubbing device; the ejection device comprises a mounting base, an ejection spring, and a movable post; both ends of the ejection spring are respectively abutted against the mounting base and the movable post; the mounting base is fixed inside the body of the floor scrubbing device; the movable post comprises a section having a large diameter and a section having a small diameter; a through hole communicated with an interior of the body of the floor scrubbing device is disposed at a bottom of the mounting recess; a diameter of the through hole is greater than the diameter of the section having the small diameter but less than the diameter of the section having the large diameter; the section having the small diameter is disposed through the through hole; and a head of the section having the small diameter is abutted against a bottom of a body of the window scrubbing device.

* * * * *